US006755768B1

(12) United States Patent
Garcia-Rill et al.

(10) Patent No.: US 6,755,768 B1
(45) Date of Patent: Jun. 29, 2004

(54) MOTORIZED BICYCLE EXERCISE TRAINER

(75) Inventors: Edgar Garcia-Rill, Little Rock, AR (US); Robert D. Skinner, Little Rock, AR (US); Nancy B. Reese, Conway, AR (US)

(73) Assignee: Board of Trustees of the University of Arkansas, Little Rock, AR (US)

( * ) Notice: Subject to any disclaimer, the term of this patent is extended or adjusted under 35 U.S.C. 154(b) by 0 days.

(21) Appl. No.: 10/322,949

(22) Filed: Dec. 18, 2002

(51) Int. Cl.[7] ..... A63B 22/00

(52) U.S. Cl. ..... 482/51; 482/7; 482/57; 482/60

(58) Field of Search ..... 482/1–9, 51, 57–60

(56) References Cited

U.S. PATENT DOCUMENTS

| | | | | | |
|---|---|---|---|---|---|
| 2,663,376 | A | | 12/1953 | Curley | |
| 2,735,422 | A | * | 2/1956 | Jones | 601/26 |
| 3,212,776 | A | | 10/1965 | Bassler | |
| D218,107 | S | * | 7/1970 | Feather | D21/666 |
| 3,730,174 | A | | 5/1973 | Madison | |
| 4,185,622 | A | * | 1/1980 | Swenson | 601/27 |
| 4,402,502 | A | * | 9/1983 | Peters | 601/36 |
| 4,478,213 | A | | 10/1984 | Redding | |
| 4,572,501 | A | | 2/1986 | Durham et al. | |
| 4,587,960 | A | * | 5/1986 | Schotten | 601/32 |
| 4,773,399 | A | | 9/1988 | Richardson | |
| 4,824,104 | A | | 4/1989 | Bloch | |
| 4,824,132 | A | | 4/1989 | Moore | |
| 4,846,156 | A | | 7/1989 | Kopnicky | |
| 4,928,673 | A | | 5/1990 | Heneger | |
| 4,947,836 | A | | 8/1990 | Laenger et al. | |
| 5,033,736 | A | | 7/1991 | Hirschfeld | |
| 5,099,828 | A | * | 3/1992 | Duke | 601/26 |
| 5,254,060 | A | * | 10/1993 | Bohanan | 482/60 |
| 5,906,563 | A | * | 5/1999 | Pittari | 482/62 |
| 5,951,442 | A | | 9/1999 | Adams et al. | |
| 6,036,623 | A | | 3/2000 | Mitchell | |
| 6,142,914 | A | | 11/2000 | Crawford et al. | |
| 6,447,428 | B1 | * | 9/2002 | McKillip | 482/57 |

FOREIGN PATENT DOCUMENTS

DE 3922538 A1 1/1991

OTHER PUBLICATIONS

Viala, G., et al., Plasticity of Locomotor Organization in Infant Rabbits Spinalized Shortly After Birth, *Development and Plasticity of the Mammalian Spinal Cord,* M.E. Goldberger, et al., Eds., Fidia Research Series, vol. III, Liviana Press, Padova, 1986, pp. 301–310.

* cited by examiner

*Primary Examiner*—Nicholas D. Lucchesi
*Assistant Examiner*—Tam Nguyen
(74) *Attorney, Agent, or Firm*—Ray F. Cox, Jr.

(57) ABSTRACT

A device for inducing a cycling motion in patients who have little or no motor control of their legs. The device has bicycle-type pedals connected via a belt or chain drive to a motor with a speed control allowing a very low rate of rotation from 0.1 cycles per second up to about 1.0 cycles per second. The device includes straps for wheelchair wheels for locking a wheelchair in position such that the patient's feet may be strapped onto the pedals. The diameter of rotation of the pedals is adjustable to accommodate different leg lengths and to allow various diameters of rotation of the pedals. The motor is housed within a console with medial and lateral supports so that the legs of the patient are maintained in alignment.

14 Claims, 7 Drawing Sheets

10
12
14
16
18
20
22
24
26
28
30
32

MOTORIZED BICYCLE EXERCISE TRAINER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a device for inducing a cycling motion in patients who have little or no motor control of their legs, and in particular, to such a device wherein the device includes a console for receiving the legs of the patient, the console having medial and lateral supports so that the legs of the patient are maintained in alignment during the cycling motion.

2. Brief Description of the Related Art

Stationary exercise bicycles are known for exercising by users who have motor control of their legs, but stationary exercise bicycles usually must be pedaled by the user and most have a way to increase resistance of the cycling motion in order to build strength and endurance.

It is known to passively exercise a wheelchair-bound person through a bicycle pedal arrangement driven by a speed-controlled electric motor. See, e.g., U.S. Pat. No. 5,033,736.

Likewise, U.S. Pat. No. 6,142,914 discloses an exercise device for use by a person sitting in a wheelchair. The device has a base which mounts onto the footrests of the wheelchair. The exercising device is adjustable on the base to accommodate the physical stature of the person sitting in the wheelchair.

In patients who have no (para- or quadraplegic) or little (multiple sclerosis (MS), cerebral palsy (CP), stroke or other fatigue and weakness-inducing disease) strength and control, cycling must begin very slowly and speed up with increases in strength. U.S. Pat. No. 6,142,914 notes that the device disclosed therein is operated at a slow speed but does not specify a particular speed as desirable. U.S. Pat. No. 4,824,104 also mentions starting the device at a slow speed. U.S. Pat. No. 3,212,776 discusses a device in which the action of the patient in opposing or working with the action of the motor causes a change in the torque applied by the mechanism to act as a compensator to smoothly resist any changes from its desired operating speed. A "maximum slow speed equilibrium" of about 8 r.p.m. is suggested.

U.S. Pat. No. 4,846,156 discloses an exercise machine for use by a person in a wheelchair. The device includes both hand cranks and foot cranks. It is suggested that the lengths of the cranks may be adjusted to aid in aerobic exercise.

In a passive exercise device, care must be taken to protect the paralyzed/weak legs from misalignment or excessive stretch, which would lead to "locking" of joints during the cycling, in order to prevent injury. A form of medial support that prevents the legs of the patient from falling inwardly is suggested by U.S. Pat. Nos. 4,402,502; 4,572,501; and 4,587,960. U.S. Pat. No. 2,663,376 discloses a training device for crippled children, comprising a series of supports for the child patient, including a medially disposed guiding member and side frames.

Some devices explicitly address the problem of the legs of the patient falling outwardly during the exercise session. For example, U.S. Pat. No. 4,478,213 discloses an exercise device in which knee straps support the legs of the patient. Another solution to this problem is to employ supports about an upper portion of the calf to prevent the leg from falling either inwardly or outwardly. Devices of this type are shown in U.S. Pat. Nos. 5,951,442; 4,402,502; and 6,036,623.

The limitations of the prior art are overcome by the present invention as described below.

BRIEF SUMMARY OF THE INVENTION

The present invention is a device for inducing a cycling motion in patients who have little or no motor control of their legs, for example, paraplegics, quadraplegics or those with MS, CP, stroke and similar diseases. The device comprises bicycle-type pedals connected via a belt or chain drive to a motor with a speed control mechanism, such as a rheostat. It is important that the device have a very low rate of rotation from 0.1 cycles per second up to about 1.0 cycles per second.

The apparatus includes means, such as clamps or straps for the wheelchair wheels, for locking a wheelchair in position such that the patient's feet may be strapped into the pedals. It is important that the legs not be fully extended at any time to avoid possible injury to the patient. The device may also include means to adjust the diameter of rotation of the pedals to accommodate individuals of different heights, including children and adults, and to allow cycling of varying diameter. The device may operate with each leg independently. The motor is housed within a center console with medial and lateral supports so that the legs of the patient are maintained in alignment.

It is therefore an object of the present invention to provide for a passive exercise device for inducing a cycling motion in patients who have little or no motor control of their legs.

It is a further object of the present invention to provide for such a device having a very low rate of rotation from 0.1 cycles per second up to about 1.0 cycles per second.

It is also an object of the present invention to provide for such a device having a console with medial and lateral supports so that the legs of the patient are maintained in alignment during the cycling motion.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
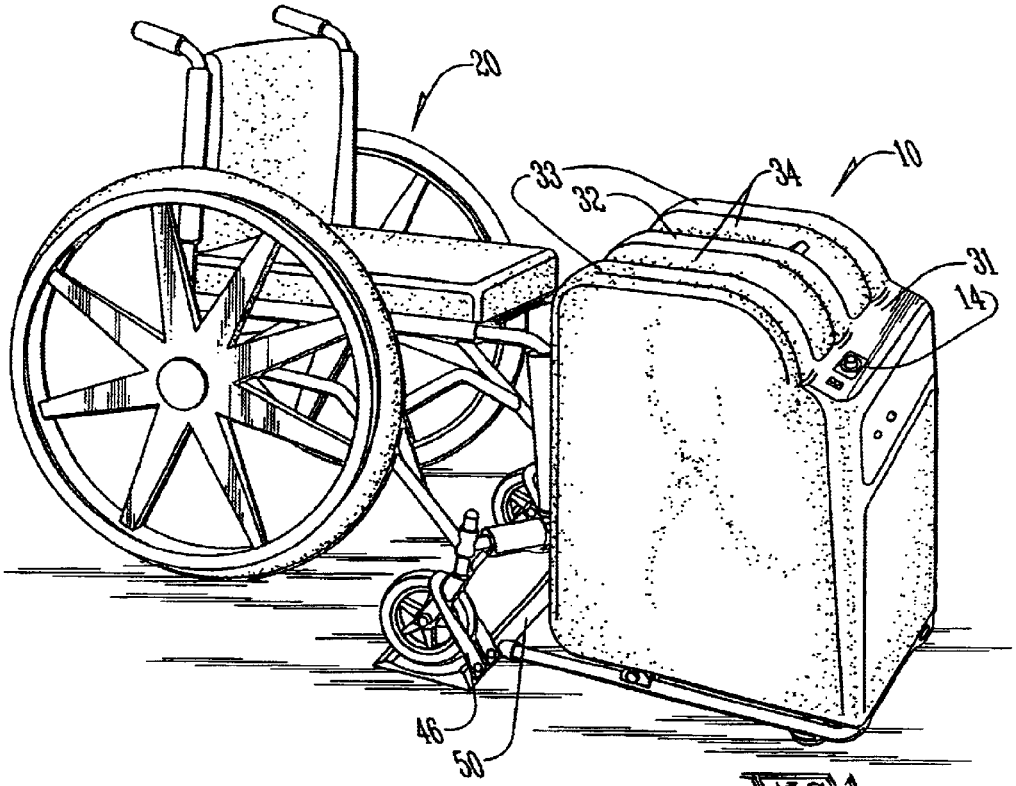
FIG. 1 is a perspective view of the passive exercise device of the present invention with a wheelchair positioned thereon.
Figure 2:
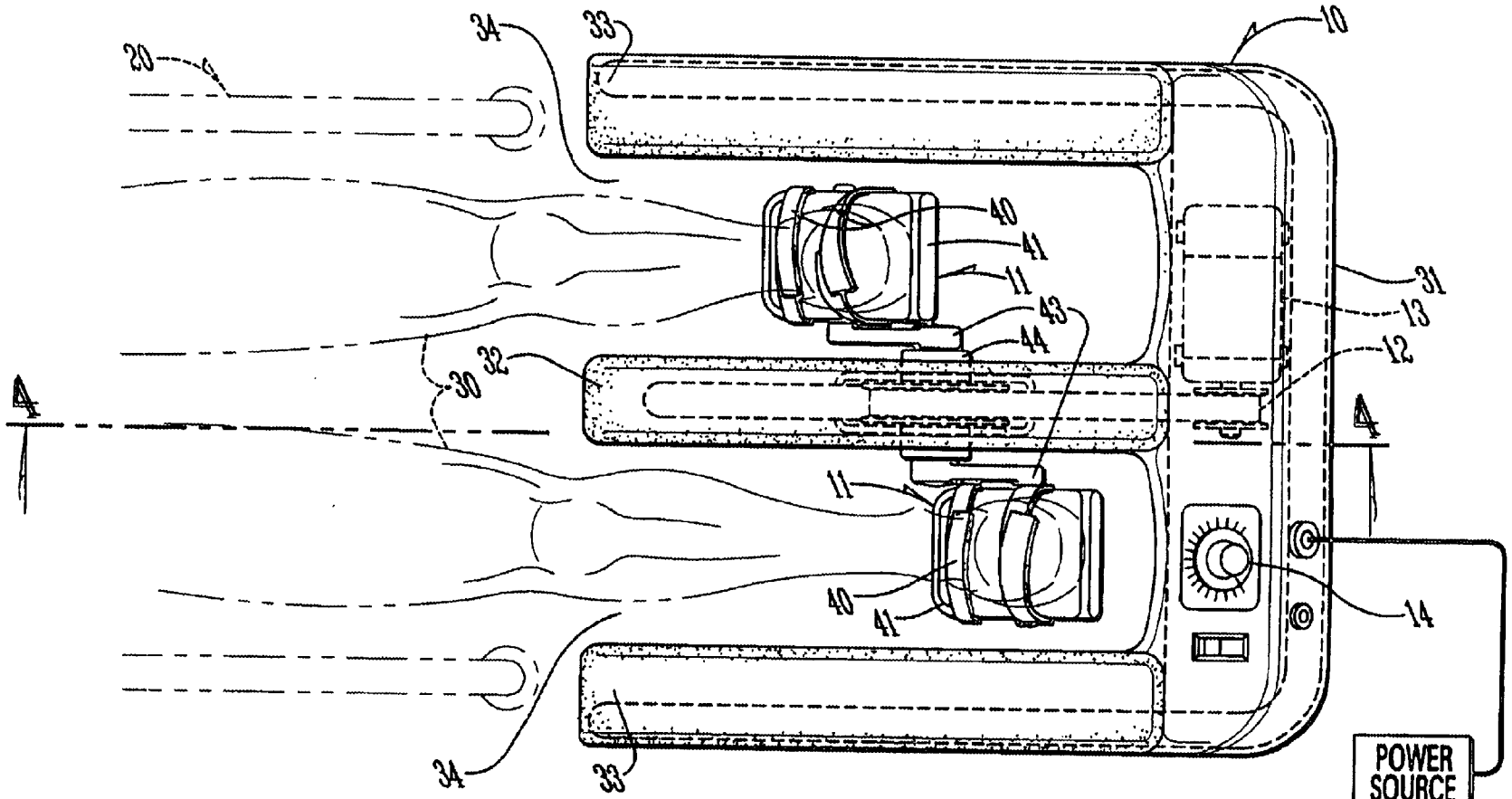
FIG. 2 is a top view of the passive exercise device showing the legs of a user in phantom outline.
Figure 3:
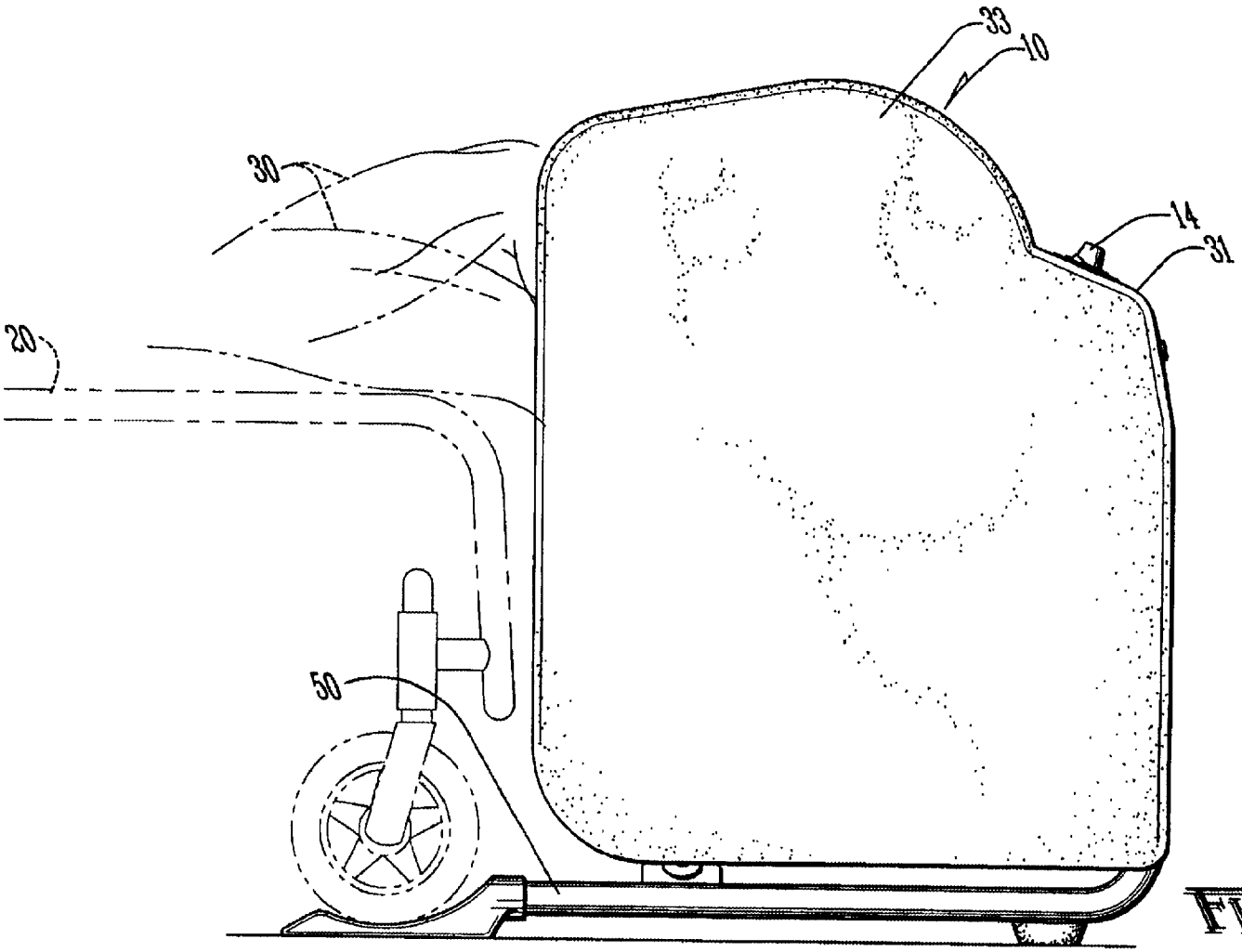
FIG. 3 is a side elevation view of the passive exercise device showing the legs of a user in phantom outline.
Figures 1, 4:
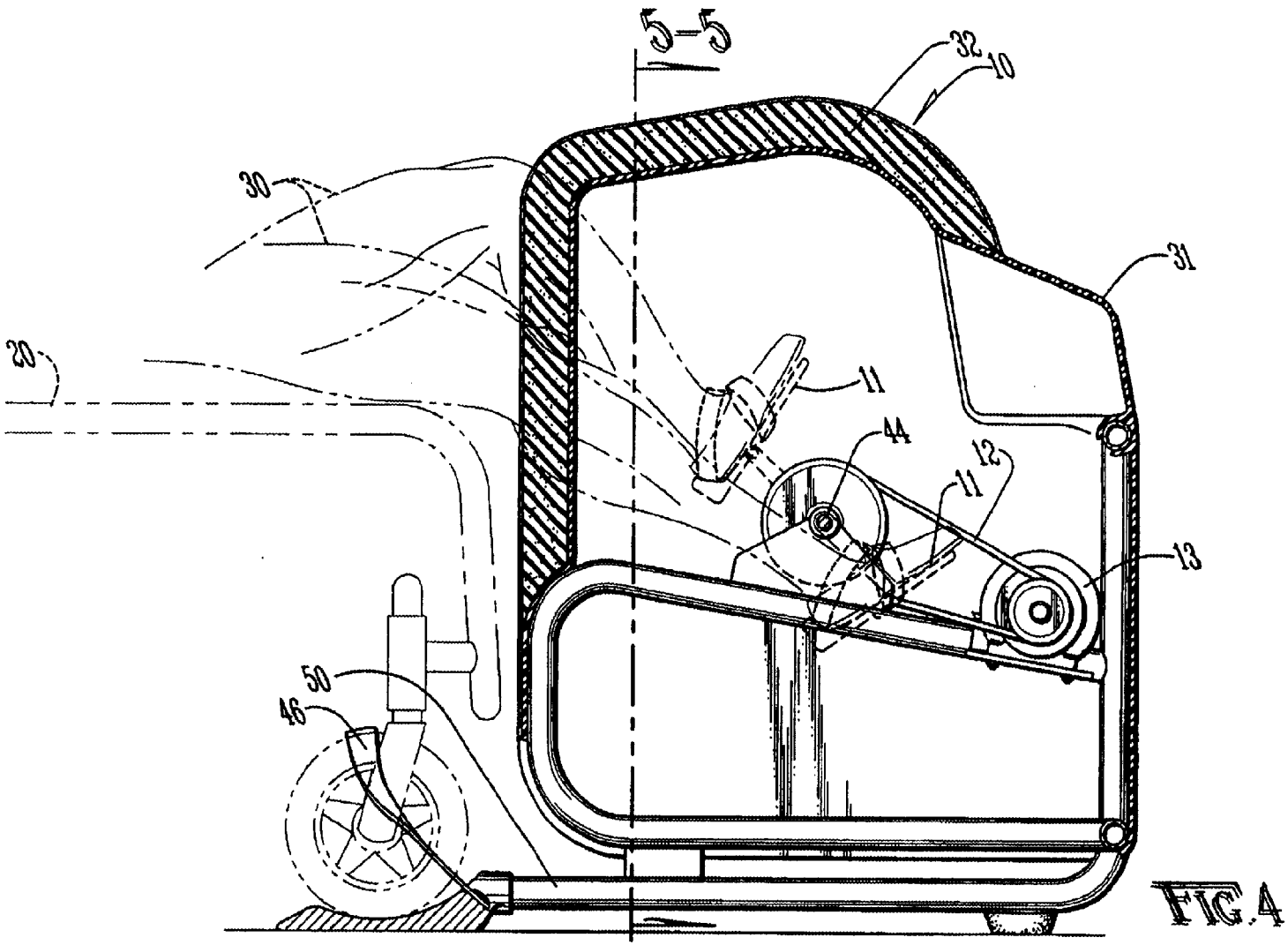
FIG. 4 is a cross sectional side elevation view of the passive exercise device along the line 4—4 of FIG. 2.
Figure 5:
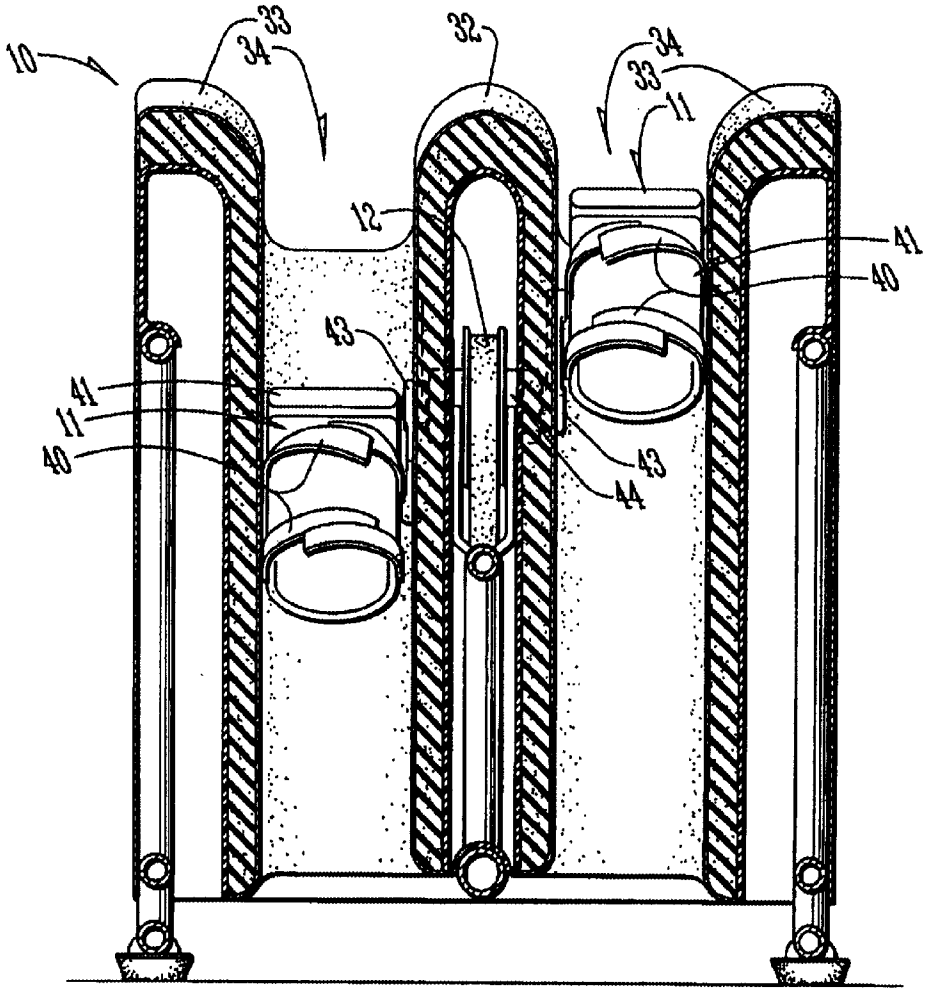
FIG. 5 is a cross sectional front elevation of the passive exercise device along the line 5—5 of FIG. 4.

With reference to FIGS. 1–5, the preferred embodiment of the present invention may be described.

The present invention is a passive exercise device 10 for inducing a cycling motion in a patient who has little or no motor control of their legs. The device 10 is mounted to a base 50 to which the wheels of a wheelchair 20 are locked. The device 10 is used in conjunction with the wheelchair 20 by a patient seated thereon. Stationary exercise bicycles usually must be pedaled by the user and most have a way to increase resistance of the cycling motion in order to build strength and endurance. The present invention induces an involuntary cycling motion in the patient so that the legs are passively cycled to produce alternating stretch reflexes of the leg muscles. Because patients using this device will have no (para- or quadraplegic) or little (MS, CP, stroke or other fatigue and weakness-inducing disease) strength and control, cycling must begin very slowly and speed up with increases in strength. Care must be taken to protect the paralyzed/weak legs from misalignment, excessive stretch or "locking" of joints during the cycling in order to prevent injury.

As shown in FIGS. 2 and 6A–D, the preferred embodiment has a set of pedals 11 operatively connected to a drive 12, which may, for example, be a chain or belt drive, which is in turn operatively connected to a slow speed electric motor 13. A speed control 14, for example a rheostat, is provided for controlling the speed of the motor 13. The motor 13 must produce a very slow speed of rotation of the pedals 11, in the range of 0.1 to 1 cycles per second.

Figures 6A, 6B:
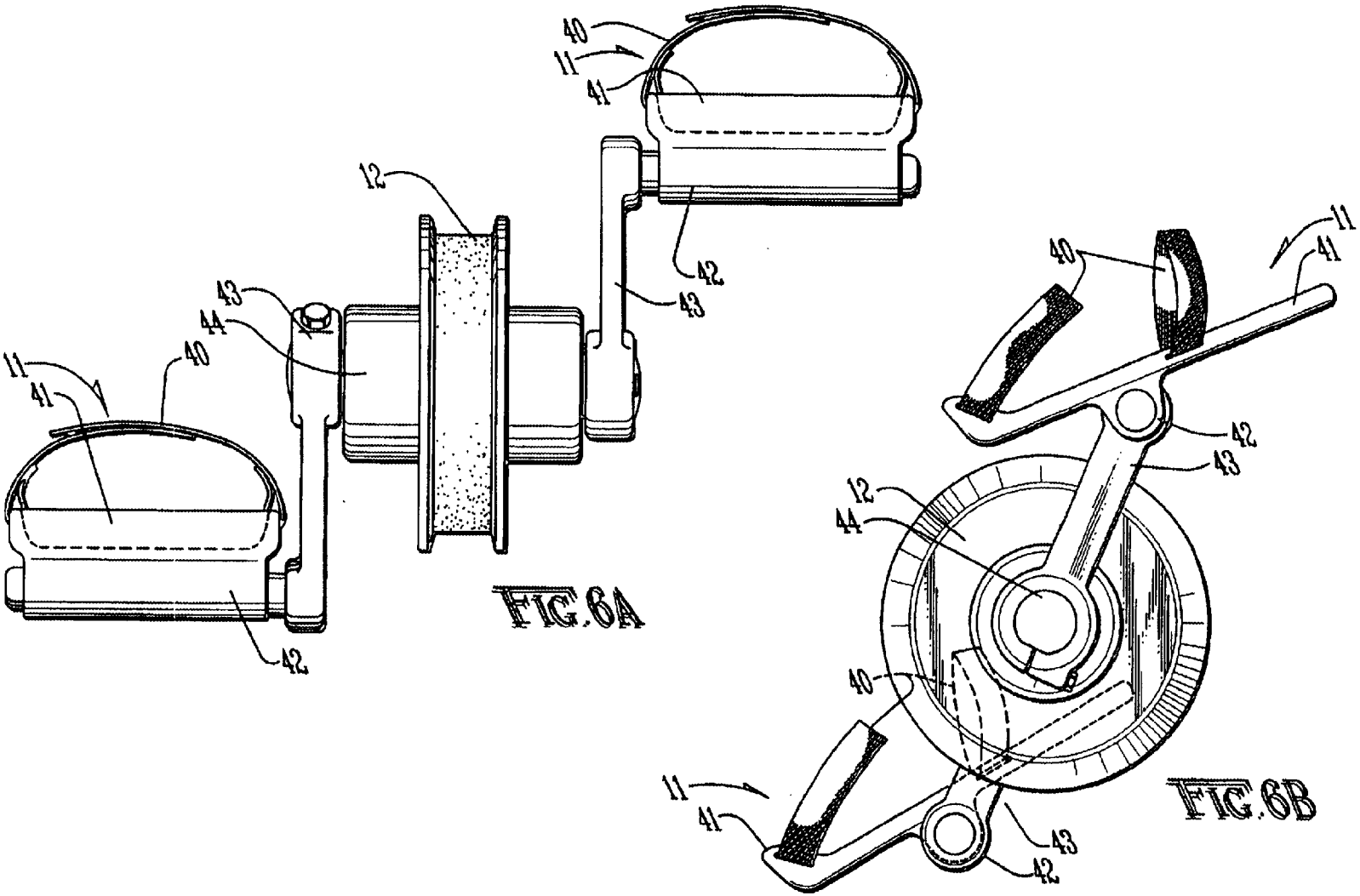
FIG. 6A is a front elevation of the pedals with a shorter set of pedal arms for a small diameter of rotation of the pedals.
FIG. 6B is a side elevation of the pedals of FIG. 6A.
Figure 6D:
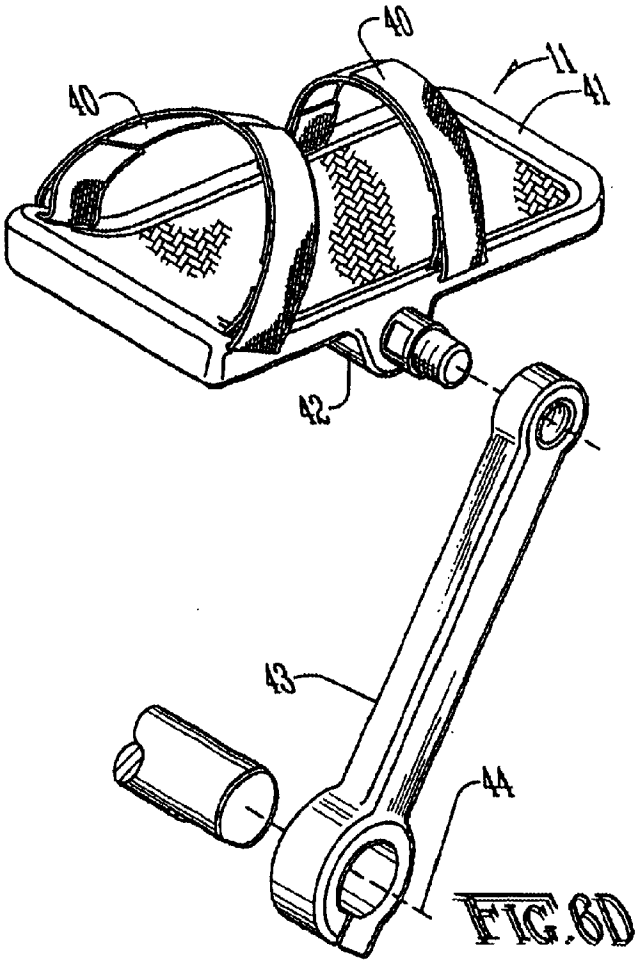
FIG. 6D is an exploded perspective view of the pedals showing how the pedals may be disassembled to change pedal arms.
Figure 6C:
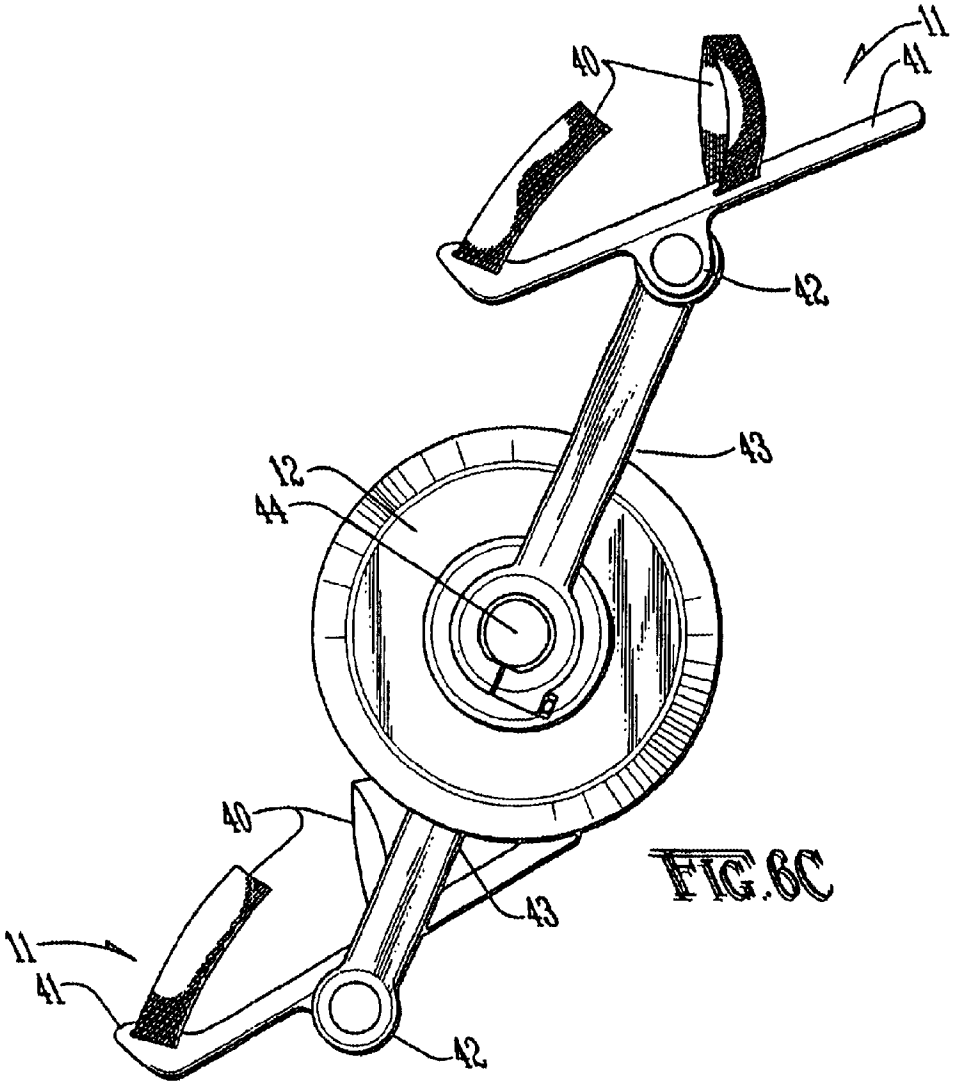
FIG. 6C is a side elevation of the pedals with a longer set of pedal arms for a larger diameter of rotation of the pedals.

Means are also provided for firmly locking the wheelchair 20 into position on the base 50; for example, straps 46 or the like may be used. The patient's legs should be slightly flexed when they are strapped into the pedals 11. The diameter of rotation of the pedals 11 may be adjustable for individuals of different height so that the legs of the patient are not maximally flexed or extended. Foot straps 40 hold the foot and heel in place on the footrest 41, which pivots on the pedal branch 42. The diameter of rotation of the pedals 11 is determined by the length of the pedal arm 43 between the pedal axis 44 and the pedal branch 42 to accommodate individuals of different heights, including children, as well as allowing rotation of varying diameter. Various means for adjusting the length of the pedal arm 43 would be acceptable in the practice of the present invention; for example, the pedal arms 43 may be provided in a range of lengths. The pedals arms 43 may be removably attached to the mechanism depending upon which pedal arm has a length which provides the desired diameter of rotation of the pedals 11. As shown in FIGS. 6A and 6B, a shorter set of pedal arms 43 provide a small diameter of rotation of the pedals 11. By disassembling the pedals 11 as shown in FIG. 6D the pedals 11 may be reassembled with pedal arms 43 of different lengths. FIG. 6C shows the pedals 11 reassembled with a longer set of pedal arms 43 for a larger diameter of rotation of the pedals 11. By this process pedals 11 having any desired diameter of rotation may be achieved.

Patients with little or no motor control of the legs may suffer from osteoporosis, making their bones very brittle. Very slow rotation speeds are used to begin training, which may be continued on to higher speeds as the patient's needs and progress dictate. The passive cycling motion induces alternating stretch reflexes of the flexor and extensor muscles of both legs. Published studies in animals have shown that such passive exercise can prevent muscle atrophy and decrease hyperreflexia. It is anticipated that by such passive exercise human patients with motor weakness, spasticity or paresis will respond by increasing muscle mass and decreasing hyperreflexia.

In passive exercise of a patient who has little or no motor control of the legs 30, it is important to avoid misalignment of the legs 30. In the present invention, this is accomplished by providing a console 31 having a medial support 32 and a pair of lateral supports 33. The medial support 32 and the lateral supports 33 are desirably smooth or padded to provide additional protection to the patient during passive exercise. The medial support 32 and the lateral supports 33 are substantially vertical walls which are spaced apart from each other so that the space between the medial support 32 and a respective lateral support 33 forms a well 34 for receiving a respective leg 30 of the patient so that each leg 30 is guided in a substantially vertical plane with minimal side-to-side motion. The medial support 32 and the lateral supports 33 desirably are formed into a unitary console 31 which also houses the pedals 11, drive 12, motor 13 and motor speed control 14.

The present invention provides the necessary conditions to safely provide passive exercise to a patient with little or no motor control of the legs. First, the device has the capability of starting rotation very slowly. Second, the device uses medial and lateral supports to avoid misalignment of the legs. Third, the wheelchair 20 is locked in position so that the extent of stretch of the patient's legs is limited, not maximal, so that there is no risk of injury from "locking" of the patient's joints. Fourth, the diameter of rotation is determined by the length of the pedal arm 43.

The present invention has been described with reference to certain preferred and alternative embodiments that are intended to be exemplary only and not limiting to the full scope of the present invention as set forth in the appended claims.

What is claimed is:

1. In a passive exercise device wherein a motor drives bicycle-type pedals to passively exercise the legs of a user, the improvement comprising:

a medial and a pair of lateral supports, one of said lateral supports disposed to one side of said medial support and another of said lateral supports disposed to an opposite side of said medial support, said medial support and each of said lateral supports defining a well adapted to receive and guide a respective leg of a user of the passive exercise device.

2. The improvement of claim 1 further comprising a motor speed control wherein the motor is adapted to operate the pedals at a rotational speed in the range of 0.1 to 1.0 cycles per second.

3. The improvement of claim 1 wherein said medial and said lateral supports comprise a unitary console.

4. The improvement of claim 1 further comprising means for locking a wheelchair into a fixed position with respect to the pedals.

5. The improvement of claim 1 further comprising means for setting a diameter of rotation of the pedals.

6. The improvement of claim 5 wherein said pedals comprise a pedal axis operatively connected for rotation to the motor, a pedal arm detachably attached at one end to said pedal axis and a pedal branch detachably attached at an opposite end of said pedal arm, said a footrest being pivotally mounted to said pedal branch.

7. The improvement of claim 6 wherein said means for setting a diameter of rotation of the pedals comprises a set of pedal arms of different lengths, each of said pedals arms having a length for setting a diameter of rotation of said pedals.

8. In a passive exercise device wherein a motor drives bicycle-type pedals to passively exercise the legs of a user with little or no voluntary motor control of the legs, the improvement comprising:

means for maintaining alignment of the legs of the user during passive exercise; said means comprising at least one pair of substantially vertical, spaced apart walls, said walls defining well means therebetween for receiving a leg of the user of the passive exercise device and for maintaining the leg in alignment during passive exercise by guiding the leg in a substantially vertical plane with side-to-side motion of the leg limited by said walls.

9. The improvement of claim 8 further comprising a motor speed control wherein the motor is adapted to operate the pedals at a rotational speed in the range of 0.1 to 1.0 cycles per second.

10. The improvement of claim 8 wherein said at least one pair of substantially vertical, spaced apart walls comprise a unitary console.

11. The improvement of claim 8 further comprising means for locking a wheelchair into a fixed position with respect to the pedals.

12. The improvement of claim 8 further comprising means for setting a diameter of rotation of the pedals.

13. The improvement of claim 12 wherein said pedals comprise a pedal axis operatively connected for rotation to the motor, a pedal arm detachably attached at one end to said pedal axis and a pedal branch detachably attached at an opposite end of said pedal arm, said footrest being pivotally mounted to said pedal branch.

14. The improvement of claim 13 wherein said means for setting a diameter of rotation of the pedals comprises a set of pedal arms of different lengths, each of said pedals arms having a length for setting a diameter of rotation of said pedals.

* * * * *